US010377612B2

(12) United States Patent
Öberg

(10) Patent No.: US 10,377,612 B2
(45) Date of Patent: Aug. 13, 2019

(54) LIFT-TRUCK WITH AUTOMATED HEIGHT ADJUSTMENT OF LOAD ENGAGEMENT MEANS

(71) Applicant: Toyota Material Handling Manufacturing Sweden AB, Mjölby (SE)

(72) Inventor: John Öberg, Mjölby (SE)

(73) Assignee: Toyota Material Handling Manufacturing Sweden AB, Mjolby (SE)

( * ) Notice: Subject to any disclaimer, the term of this patent is extended or adjusted under 35 U.S.C. 154(b) by 135 days.

(21) Appl. No.: 15/434,567

(22) Filed: Feb. 16, 2017

(65) Prior Publication Data

US 2017/0240396 A1 Aug. 24, 2017

(30) Foreign Application Priority Data

Feb. 19, 2016 (EP) ..... 16156499

(51) Int. Cl.
*B66F 9/075* (2006.01)
*B66F 9/065* (2006.01)
*B66F 7/06* (2006.01)

(52) U.S. Cl.
CPC ..... *B66F 9/0755* (2013.01); *B66F 7/065* (2013.01); *B66F 9/065* (2013.01)

(58) Field of Classification Search
CPC ..... B66F 9/0755; B66F 7/065; B66F 9/065
See application file for complete search history.

(56) References Cited

U.S. PATENT DOCUMENTS 4,598,797 A * 7/1986 Schultz ..... B66F 17/003 180/271
5,222,857 A * 6/1993 Hasegawa ..... B65G 59/023 414/788.4

(Continued)

FOREIGN PATENT DOCUMENTS

DE 200 20 741 4/2002
DE 20 2012 004 038 8/2013

(Continued)

OTHER PUBLICATIONS

The extended European search report from the European Patent Office, dated Aug. 10, 2016, pp. 1-5, for European Patent Application No. 16156499.2.

*Primary Examiner* — Thomas G Black
*Assistant Examiner* — Sze-Hon Kong
(74) *Attorney, Agent, or Firm* — Quarles & Brady LLP

(57) ABSTRACT

A lift-truck including a support means extending from a load engagement means; a distance sensor to measure the distance (D) to the load engagement means; a control unit connected to an operator interface and a lifting/lowering unit and to the distance sensor, the distance sensor attached to the support means at a fixed distance above the load engagement means, the control unit receives start signal from the operator interface and performs a height adjustment cycle of the load engagement means comprising; determining a default distance ($D_0$) to the surface on the load engagement means; determining the present distance (D) to the surface on the load engagement means; comparing the default distance ($D_0$) and the present distance (D); moving the load engagement means a distance (R) when a difference ($D_{delta}$) between the default distance ($D_0$) and the present distance (D) is determined, the distance (R) depends on the difference ($D_{delta}$).

15 Claims, 3 Drawing Sheets

(56) References Cited

U.S. PATENT DOCUMENTS

| | | | | |
|---|---|---|---|---|
| 6,155,551 | A * | 12/2000 | Russ | B65H 29/50 270/30.01 |
| 6,364,330 | B1 * | 4/2002 | Weber | B62B 1/10 108/136 |
| 9,796,540 | B1 * | 10/2017 | Shellenbaum | B65G 67/04 |
| 2005/0236787 | A1 * | 10/2005 | Weber | B62B 1/10 280/47.35 |
| 2008/0000393 | A1 * | 1/2008 | Wilson | A47F 3/14 108/20 |
| 2010/0183412 | A1 * | 7/2010 | Borntrager | B62D 51/04 414/541 |
| 2012/0180704 | A1 * | 7/2012 | Taylor | A47F 3/14 108/20 |
| 2014/0071430 | A1 * | 3/2014 | Hansen | B66F 9/0755 356/4.01 |
| 2016/0347558 | A1 * | 12/2016 | Eto | B65G 47/91 |
| 2017/0152098 | A1 * | 6/2017 | Chow | B65D 83/0005 |

FOREIGN PATENT DOCUMENTS

| | | |
|---|---|---|
| EP | 1 731 477 | 12/2006 |
| EP | 2 181 959 | 5/2010 |
| EP | 2 269 922 | 1/2011 |
| EP | 2 955 149 | 12/2015 |
| FR | 2 652 071 | 3/1991 |

* cited by examiner

LIFT-TRUCK WITH AUTOMATED HEIGHT ADJUSTMENT OF LOAD ENGAGEMENT MEANS

CROSS-REFERENCE TO RELATED APPLICATIONS

This application claims the priority benefit of European Patent Application No. 16156499.2 filed Feb. 19, 2016, the contents of which is hereby incorporated by reference as if set forth in its entirety herein.

TECHNICAL FIELD

The present disclosure relates to a lift-truck comprising a control means configured to automatically adjust the height of the load engaging means of the lift-truck in dependency of the variation of the level of goods on the load engaging means.

BACKGROUND ART

Lift-trucks are often used in order picking operations where an operator manually collects goods from the shelves in warehouse and places the goods on the load engagement means of the lift-truck. A general problem associated with order picking is that the working height of the operator changes as the goods accumulate on the load engagement means, or are removed there from. To find an ergonomically correct working position, the operator is therefore forced to repeatedly raise or lower the load engagement means of the lift-truck. This is time consuming and reduces the efficiency of the order picking operation.

Attempts have been made to address this problem. DE 20 2012 004 038 U1 describes a forklift truck comprising a load carrier which is connected by a chain/pulley arrangement to a telescopic lifting mast such that the load carrier is raised on the mast when the telescopic mast is extended. A laser sensor is attached to the top of the telescopic mast to measure the distance from the sensor to the goods on a load carrier. The laser sensor is connected to a control unit which determines changes in the distance between the sensor and the goods on the load carrier and adjusts the height of the load carrier accordingly. However, since the load carrier and the telescopic mast are movable relative each other, the distance between the load carrier and the laser sensor may change when the height of the load carrier is adjusted. This may in turn cause inaccuracies in the determination of the level of the goods on the load carrier.

As a consequence, the automated height adjustment of the load carrier is rather complicated and dependent on several parameters, such as desired working height and actual load carrier height, which are feed to the control unit. Determination of these parameters further requires multiple distance measurements in different directions and that the control unit performs various calculations.

Thus, it is an object of the present disclosure to provide an improved lift-truck which solves or at least mitigates one of the problems of the prior-art. In particular, it is an object of the present disclosure to provide a lift-truck which provides for simple and reliable automatic adjustment of the load engagement means in dependency of changes of the level of goods thereon. In addition it is an object of the present disclosure to provide an inexpensive lift-truck which provides for simple and reliable automated adjustment of the load engagement means.

SUMMARY OF THE INVENTION

According to a first aspect of the present disclosure at least one of the aforementioned objects is met by a lift-truck 100 comprising:

- a load engagement means 1 arranged to be moved by a lifting/lowering unit 50;
- a support means 10 extending from the load engagement means 1;
- a distance sensor 40 directed towards the load engagement means 1 and configured to measure the distance (D) to a surface 4, 60 on the load engagement means 1;
- a control unit 51 connected to an operator interface 52 and to the lifting/lowering unit 50 and to the distance sensor 40,
- the distance sensor 40 is attached to the support means 10 at a fixed distance above the load engagement means 1,
- wherein the control unit 51 is configured to receive a start signal from the operator interface 52 and in response thereto performing a height adjustment cycle of the load engagement means 1 comprising;
- determining a default distance ($D_0$) to the surface 4, 60 on the load engagement means 1;
- determining the present distance (D) to the surface 4, 60 on the load engagement means 1;
- comparing the default distance ($D_0$) and the present distance (D);
- moving the load engagement means 1 a distance (R) when a difference ($D_{delta}$) between the default distance ($D_0$) and the present distance (D) is determined, wherein the distance (R) depends on the difference ($D_{delta}$).

In the lift-truck according to the disclosure the distance sensor is attached to a support which extends from the load engagement means. Therefore, the distance sensor will always be at a predetermined and constant position above the surface of the load engagement means, regardless of the actual height of the load engagement means or movement of any other parts of the lift-truck. In practice, there are therefore no error sources that needs to be considered and the control unit may adjust the height of the load engagement means in direct dependency to a detected change of the distance between the sensor and the surface of the load engagement means, or goods thereon. Nor does the control unit need to consider the starting height of the load engagement means or any height adjustment that has occurred earlier during the order picking operation. In summary, the control unit of the lift-truck of the present disclosure may be of low-complex configuration and needs as in-data merely the distance measurements from the distance sensor and a simple on-off start signal to initiate the height adjustment cycle.

Further alternatives of the present disclosure are disclosed in the appended claims and the following detailed description.

DETAILED DESCRIPTION OF EMBODIMENTS

Above and hereinafter "a surface on the load engagement means" is meant either the upper surface of the load engagement means or the upper surface of goods that are placed on the load engagement means.

When directions such as "upwards/downwards" are used in the present disclosure these are intended to be understood in relation to the ground on which the lift-truck is standing. Thus, by "upwards/downwards" is meant a direction away from respectively towards the ground on which the lift-truck is standing.

The lift-truck according to the present disclosure will now be described more fully hereinafter. The lift-truck according to the present disclosure may however be embodied in many different forms and should not be construed as limited to the embodiments set forth herein. Rather, these embodiments are provided by way of example so that this disclosure will be thorough and complete, and will fully convey the scope of the present disclosure to those persons skilled in the art. Same reference numbers refer to same elements throughout the description.

A lift-truck is configured to engage, lift and transport a load. The lift-truck is operated, or driven, by an operator and may be self-propelled or arranged to be moved manually by the operator. One example of a lift-truck is a forklift truck which comprises a load engagement means in the form of a lifting fork. However, a lift-truck may also comprise other types of load engagement means such as clamping means which are configured to be moved towards each other to grip and clamp a load to be lifted.

Figure 1:
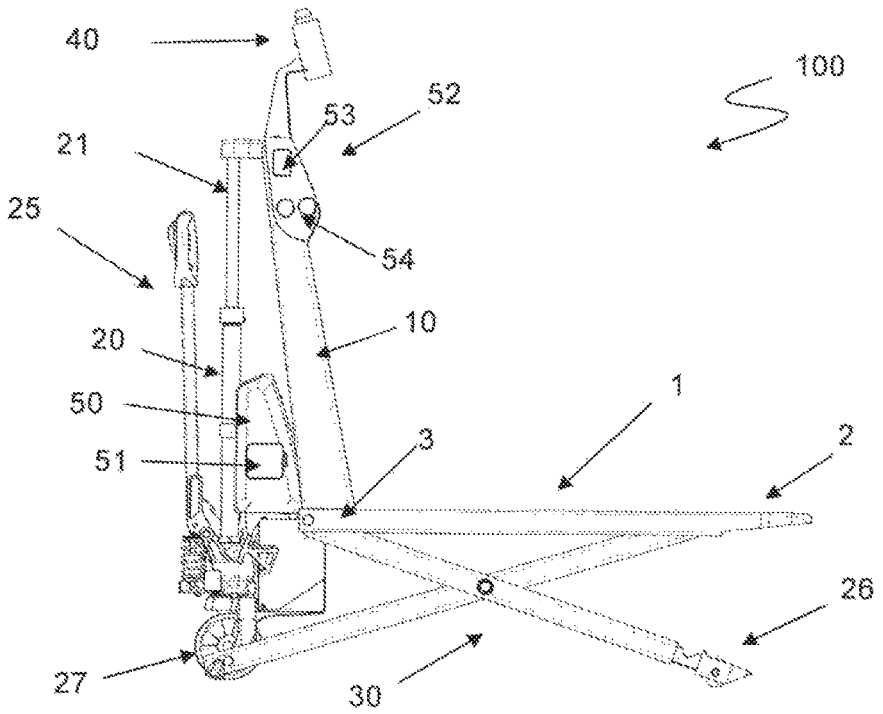
FIG. 1: A schematic side view drawing of a lift-truck according to a first preferred embodiment of the present disclosure.
Figure 2:
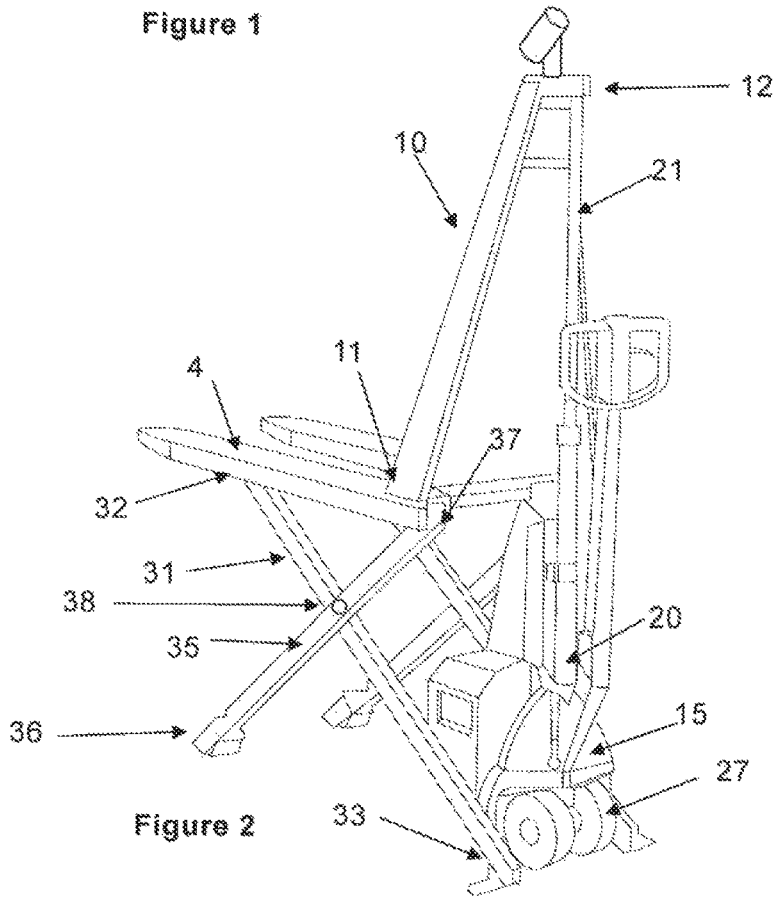
FIG. 2: A perspective rear view of the lift-truck according to the first preferred embodiment of the present disclosure.

FIG. 1 shows a lift-truck 100 according to a first preferred embodiment of the present disclosure. The lift-truck 100 is a so called hand pallet truck which is typically used for order picking operations. FIG. 2 shows a perspective rear view of the lift-truck 100 of FIG. 1.

The lift-truck 100 comprises a load engagement means 1 in the form of a lifting fork i.e. having two spaced apart forks. The load engagement means 1 has a front end 2 adapted to engage a load for example a pallet and a rear end 3 to which a support 10 is attached, for example by welding. Turning to FIG. 2, the support 10, which is a so called A-frame, extends in a direction away from the upper surface 4 of the load engagement means such that the top 12 of the support is above the upper surface 4 of the load engagement means. The base 11 of the support 10 extends in transverse direction over the rear end of the load engagement means. The support may also be a bar or a beam or a structure of several joined bars or beams.

The lifting truck further comprises a rear frame 15 which supports a rear wheel 27 and a hydraulic cylinder arrangement comprising a hydraulic piston 21 and a hydraulic cylinder 20. The hydraulic cylinder 20 is supported on the rear frame 15 above the rear wheel 27 and the hydraulic piston 21 is attached to the top 12 of the support 10. A tow bar 25 is coupled to the rear wheel 27 such that turning of the tow bar causes turning of the rear wheel 27 and thereby provides steering of the lift-truck. The tow bar 25 is also coupled to the hydraulic cylinder arrangement such that the tow bar 25 may be used as lever to manually pump hydraulic fluid into the hydraulic cylinder 20 in order to force the hydraulic piston 21 out of the hydraulic cylinder.

The lift-truck 100 further comprises a scissor lift arrangement 30 which is coupled to the lower surface of the lifting forks. The scissor lifting arrangement 30 comprises two pairs of bars 31, 35. In each pair, the first end 32 of the first bar 31 is pivotally attached to the lower surface of the front end of the load engagement means 1 and the second end 32 of the first bar is pivotally attached to the rear frame 15 of the lift-truck. The first end 37 of the second bar 35 is pivotally attached the rear end of the load engagement means and the second end 36 of the second bar 35 is provided with a support wheel 26 (see FIG. 1). The first and second bars 31, 35 of each pair are further pivotally attached to each other by a pivot pin 38. Thus, when the hydraulic cylinder arrangement is actuated, the hydraulic piston 21 lifts the support 10 and the load engagement means 1 upwards away from the ground. Simultaneously, the first and second bars 31, 35 of the scissor lift arrangement 30 pivots towards each other such that the load engagement means 1 constantly is supported by the scissor lift arrangement 30.

Returning to FIG. 1, the lift-truck 100 further comprises a lifting/lowering unit 50 for moving the load engaging means 1 upwards and downwards. The lifting/lowering unit 50 comprises an electrical pump (not shown) which is connected to the hydraulic cylinder arrangement such that the pump, when activated, may supply hydraulic fluid into the hydraulic cylinder 20 and force the hydraulic piston 21 out of the hydraulic cylinder 21. The lifting/lowering unit 50 further comprises hydraulic valves (not shown) for releasing hydraulic fluid from hydraulic cylinder. The valves are preferably designed to release hydraulic fluid from the hydraulic cylinder with a predetermined rate, thereby enabling controlled lowering of the load engagement means 1. The hydraulic cylinder arrangement and the scissor lift arrangement 30 may respectively be part of the lift/lowering unit 50.

Also included in the lift-truck 100 is an electrical battery for powering the lifting/lowering unit 50, and necessary electrical wiring, electronic circuits and hydraulic components as is known to the skilled person. These components are not shown in the drawings.

According to the disclosure, the lift-truck comprises a distance sensor 40 which is attached to the support 10 at a fixed and predetermined distance above the load engagement means 1. The sensor 40 is directed towards the upper surface 4 of the load engagement means 1. The sensor is configured to measure the distance, from the sensor it self, to a surface on the load engagement means. The sensor is a contact less distance sensor and may be laser sensor, for example a VDM28-8-L-IO/73c/110/122 available commercially by the company Pepperl+Fuchs group. The sensor may also be sonic sensor, such as an ultra-sound senor of the type UC2000-L2-I-V15 available commercially by the company Pepperl+Fuchs group.

Preferably, the distance sensor 40 is oriented towards a predetermined area on the upper surface 4 of the load engagement means 1. The predetermined area is preferably adjacent to the base 11 of the support 10, thus at the rear end 3 of the load engagement means 1. Thus, the predetermined area preferably extends from the base 10 of the support 11 towards the front end 2 of the load engagement means 1. This is an easy measure for avoiding premature movement of the load engagement means. This is so since the operator without burden may adapt his work schedule such that a layer of goods is placed on the load engagement means in order from the front end 2 of the load engagement towards the rear end 3. When the last piece of goods is laid down at the rear end 3 of the load engagement means the layer of goods is complete and simultaneous the distance sensor 40 detects a difference in the distance to the surface on the load engagement means and initiates the adjustment cycle. Preferably, the distance sensor is locked in a predetermined angular orientation to avoid error sources.

Due to the simple and effective arrangement of the sensor on the truck, it is sufficient that the lift-truck comprises one single distance sensor. This reduces the costs for the lift-truck considerably. It is however also possible to have more than one distance sensor in order to increase the detection area.

The lift-truck 100 further comprises an operator interface 52 to enable the operator of the lift-truck to start or end an automatically height adjustment cycle of the load engagement means 1. Typically, the operator interface 52 comprises at least one activation means 54 which may be displaced manually by the operator between an off-state and on-state to activate (on-state) or inactivate (off-state) a height adjustment cycle of the load engagement means. The activation means 54 is for example a press-button or a switch or a touch screen.

It is also possible that the activation may be displaced in one off-state and two different on-states. The activation means 54 is thereby configured to, in the first on-state, activate the height adjustment cycle and limit movement of the load-engagement means 1 in first direction, e.g. upwards. The activation means 54 is thereby configured to, in the second on-state, activate the height adjustment cycle and limit movement of the load-engagement means in second direction, e.g. downwards. This is an effective safety measure since movement of the load engagement means in an unexpected direction is avoided. The activation means 54 may thereby a switch, which is displaceable in the three different states. It is also possible that the operator interface 52 comprises two activation means 54. The first activation means 54 may be configured to activate the height adjustment cycle and limit movement of the load-engagement means 1 in first direction, e.g. upwards. The second activation means 54 may be configured to activate the height adjustment cycle and limit movement of the load-engagement means in second direction, e.g. downwards The operator interface 52 may also comprise an actuator 53 connected to the lift/lowering unit 50 so that the driver manually may control the lift/lowering unit 50 to raise or lower the load engagement means 1 to a preferred picking height.

The lifting truck also comprises a control unit 51 which is connected to the distance sensor 40, to the operator interface 52 and to the lifting/lowering unit 50. The control unit 51 is typically a PLC (Programmable Logic Controller) for example a CR0411 mobile controller available commercially from the company Ifm electronic gmbh.

The control unit 51 is configured to receive a start signal from operator interface 52, typically a digital signal indicating a change from off-state to on-state. The control unit 51 is also configured to receive a signal from the distance sensor 40 indicative of the distance from the distance sensor 40 to a surface on the load engagement means. The control unit 51 is further configured to initiate an automatic adjustment cycle of the height of the load engagement means when the start signal is received.

The steps of the height adjustment cycle will be described hereinafter with reference to FIGS. 4*a*-4*f*.

Figure 4A:
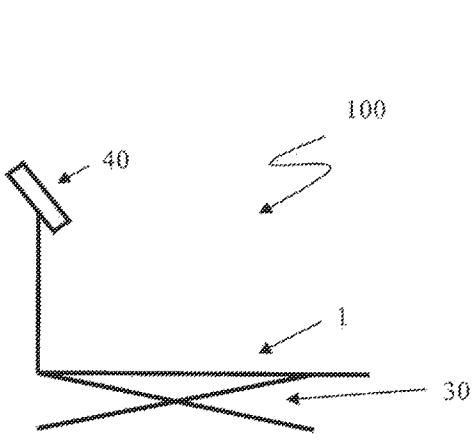
FIG. 4*a*-4*f*: Schematically drawings explaining a height adjustment cycle of a lift-truck according to the preferred embodiment of the present disclosure.
Figure 4B:
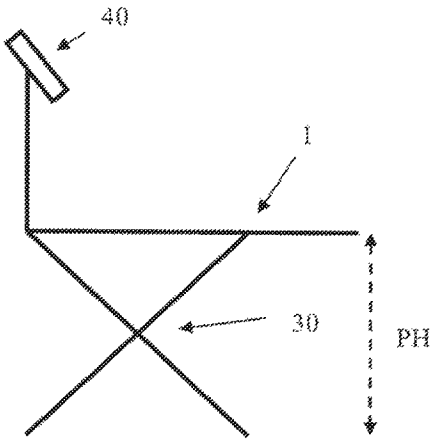
Figure 4C:
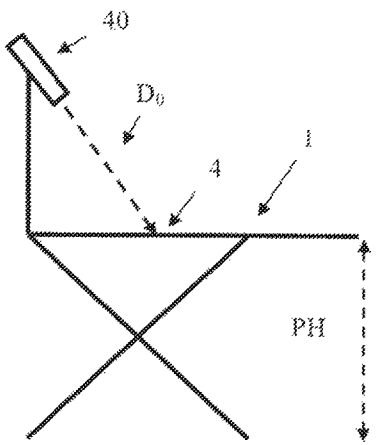
Figure 4D:
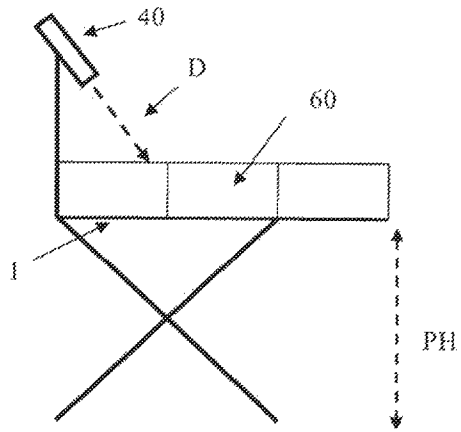
Figure 4E:
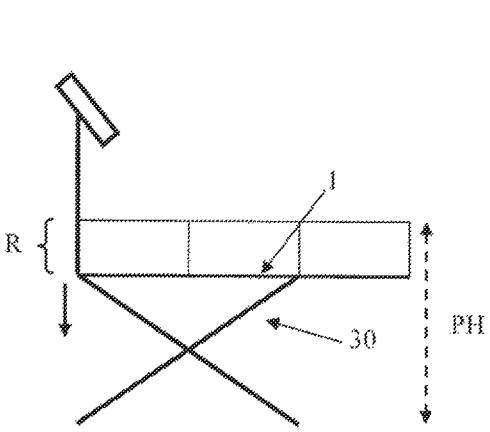
Figure 4F:
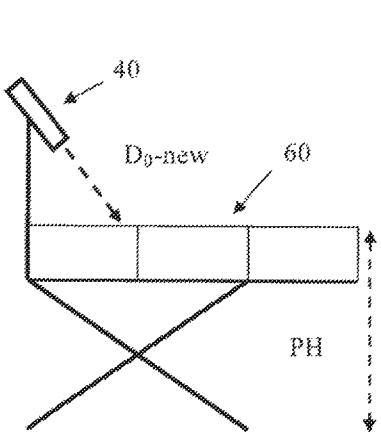

FIG. 4*a* shows the lift-truck 100 in an idle state in which the load engagement means 1 are lowered to the ground.

In an optional pre-step (FIG. 4*b*), the operator manually moves the load engagement means 1 to a preferred picking height (PH). That is, a height which is ergonomically correct for the operator to place goods on the load engagement means. Movement of the load engagement means 1 may be preformed in that the operator manually actuates the hydraulic cylinder arrangement 20, 21 by the tow bar 25. Movement of the load engagement means 1 may also be performed by running the lifting/lowering unit 50. That is, the operator runs the lift/lowering unit 50 manually via the operator interface 52. The control unit 51 is not involved during manual movement of the load engagement means 1.

In a first step (not shown), the operator displaces the manual activation means 54 on the operator interface 52 from an off-state to an on-state. A start signal is thereby sent from the operator interface 52 to the control unit 51 which in response thereto initiates the height adjustment cycle of the load engagement means 1. The purpose of the height adjustment cycle is to maintain the previously set preferred picking height as the level of goods on the load engagement means increase or decrease.

In a second step (FIG. 4*c*), the control unit 51 determines a default distance $D_0$ to the surface 2 on the load engagement means. Typically the default distance $D_0$ is the present distance from the distance sensor 40 to the surface 4 on the load engagement means immediately at initiation of the height adjustment cycle. The default distance $D_0$ is registered in the control unit 51, for example in a memory in the control unit.

In a third step (FIG. 4*d*), the distance sensor 40, measures the present distance D to the surface 4, 60 on the load engagement means 1 during the order picking operation. The distance measurement may be performed periodically, that is intermittent, and repeated with any interval between measurements. The distance measurement may also be performed continuously. The present distance D is transmitted to the control unit 51.

In a fourth step (not shown) the control unit 51 compares the present distance D with the default distance $D_0$ and the present distance D and determines the difference $D_{delta}$ between $D_0$ and D.

In a fifth step (FIG. 4*e*), when a difference $D_{delta}$ is determined, the control unit 51 moves the load engagement means 1 via the lifting/lowering unit 50, a distance R such that the preferred picking height PH is maintained. The magnitude of the distance R depends on the determined difference $D_{delta}$. The distance R may thereby be equal to the difference $D_{delta}$. However, the distance R may also be equal to the difference $D_{delta}$ times a weighting factor. The weighting factor may be determined by experience in dependency of for example the size and geometry of the goods that are picked and placed on the load engagement means. Weighting factors may also be determined for the position and angular orientation of the sensor, for example by experiments. By including a weighting factor discrepancy between the determined difference $D_{delta}$ and the actual change in order picking height may be minimized.

The direction of movement of the load engagement means 1 may be determined by the sign of the determined difference $D_{delta}$. For example when the difference between $D_0$ and D is negative the load engagement means should be lowered since the level of the goods on the load engagement means has increased.

To raise the load engagement means a distance R, the pump of the lifting/lowering unit 50 may be run for a predetermined time. There is a relationship between the running time of the pump and the distance that the load engagement means 1 is raised. Typically the relationship is linear. The relationship between the running time of the pump and the raised distance of the load engagement means may be stored in the control unit 51 and used to control lifting/lowering unit 50. The pump may be a micro power pack commercially available from the company Jtekt HPI.

To lower the load engagement means 1 a distance R, the valves for releasing hydraulic fluid of the lifting/lowering unit 40 are opened for a predetermined time. There is a linear relationship between opening time of the hydraulic valves and the distance that load engagement means is lowered. This relationship may be stored in the control unit and used to control lifting/lowering unit. Such valves, for example a Z101049 valve commercially available from the company Jtekt HPI.

In a sixth, optional step, (FIG. 40 the control unit 51 re-initiates the height adjustment cycle described above and determines a new default distance $D_0$ for the distance to a surface 4, 60 on the load engagement means. The new default distance $D_0$ may be the present distance D at initiation of the new height adjustment cycle. It may also be the initial default distance plus the determined difference $D_{delta}$.

The height adjustment cycle may be run until the operator of the lift-truck sets the activation means 54 in off-state or until the load engagement means 1 reaches its maximum or minimum height. The maximum or minimum height is typically indicated by sensors or by physical stops on the lift-truck.

Although a particular embodiment has been disclosed in detail this has been done for purpose of illustration only, and is not intended to be limiting. In particular it is contemplated that various substitutions, alterations and modifications may be made within the scope of the appended claims.

Figure 3:
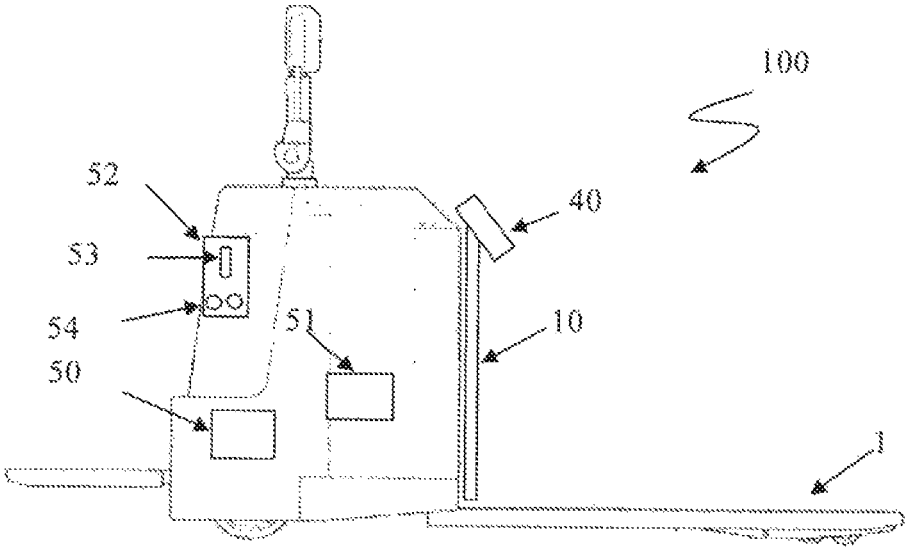
FIG. 3: A schematic side view drawing of a lift-truck according to a second preferred embodiment of the present disclosure.

For example, other types of lift-trucks than hand pallet trucks may be provided with a distance sensor and a control unit according to the present disclosure. For example as shown in FIG. 3, the lift-truck 100 may be a so called tiller arm truck. The tiller arm truck comprises a load engagement means 1 which may be raised or lowered by a lifting/lowering unit 50 comprising a hydraulic cylinder arrangement and a pump and release valves (not shown). A distance sensor 40 is attached to a support 10 which extends from the rear of the load engagement means 1. The tiller arm truck further comprises an operator interface 52 and a control unit 51 which is configured to receive a start signal from the operator interface 52 and in response thereto performing a height adjustment cycle of the load engagement means as disclosed here above.

Moreover, although specific terms may be employed herein, they are used in a generic and descriptive sense only and not for purposes of limitation. Furthermore, as used herein, the terms "comprise/comprises" or "include/includes" do not exclude the presence of other elements. Finally, reference signs in the claims are provided merely as a clarifying example and should not be construed as limiting the scope of the claims in any way.

The invention claimed is:

1. A lift-truck for moving a load, the lift truck comprising:

a load engager configured to support the load;

a lifting/lowering unit configured to move the load engager;

a support extending from the load engager;

a distance sensor directed towards the load engager and configured to measure the distance (D) to a surface on the load engager;

a control unit connected to an operator interface, the lifting/lowering unit, and the distance sensor;

wherein the distance sensor is attached to the support means at a fixed distance above the load engager;

wherein the control unit is configured to receive a start signal from the operator interface and in response thereto performing a height adjustment cycle of the load engager comprising:

determining a default distance ($D_0$) to the surface on the load engager;

determining the present distance (D) to the surface on the load engager;

comparing the default distance ($D_0$) and the present distance (D); and moving the load engager a distance (R) when a difference ($D_{delta}$) between the default distance ($D_0$) and the present distance (D) is determined, wherein the distance (R) depends on the difference ($D_{delta}$).

2. The lift-truck according to claim 1, wherein the operator interface comprises an activator configured to be displaced manually by an operator between an off-state and on-state, wherein the start signal is sent to the control unit when the activator is displaced into the on-state.

3. The lift-truck according to claim 1, wherein the default distance ($D_0$) is the present distance (D) from the distance sensor to the surface on the load engager at the initiation of the height adjustment cycle.

4. The lift-truck according to claim 1, wherein the control unit is configured to;

at least periodically determine the present distance (D) to the surface on the load engager.

5. The lift-truck according to claim 1, wherein the control unit is configured to, after moving the load engager;

re-initiate the height adjustment cycle.

6. The lift-truck according to claim 5, wherein the default distance ($D_0$) of the re-initiated cycle is the sum of the default distance ($D_0$) and the difference ($D_{delta}$) of the previous height adjustment cycle.

7. The lift-truck according to claim 1, wherein the control unit is configured to move the load engager when the difference ($D_{delta}$) is equal to or exceeds a predetermined threshold value.

8. The lift-truck according to claim 1, wherein the distance (R) is equal to the difference ($D_{delta}$) or to the difference ($D_{delta}$) times a weighting factor.

9. The lift-truck according to claim 1, wherein the control unit is configured to move the load engager in a direction which is determined by the sign of the difference ($D_{delta}$).

10. The lift-truck according to claim 1, wherein the control unit is configured to receive a direction signal from the operator interface, wherein the direction signal determines the direction of movement of the load engager.

11. The lift-truck according to claim 1, wherein the lifting/lowering unit is arranged to be operated by a human operator to move the load engager prior to initiation of the height adjustment cycle.

12. The lift-truck according to claim 11, wherein the operator interface comprises an actuator configured to be manually operated by a human operator, wherein the lifting/lowering unit is run when the actuator is operated.

13. The lift-truck according to claim 1, further comprising a hydraulic cylinder arrangement and a lever, wherein the hydraulic cylinder arrangement comprises a hydraulic piston which is coupled to the load engager and a hydraulic cylinder, whereby the lever is coupled to the hydraulic cylinder such that the hydraulic piston lifts the load engager when a human operator operates the lever.

14. The lift-truck according to claim 1, wherein the load engager is supported by a scissor lift arrangement.

15. The lift-truck according to claim 1, wherein the lift-truck is a hand pallet truck.

* * * * *